United States Patent [19]

De Fries

[11] 4,222,468

[45] Sep. 16, 1980

[54] COMBINATION PORTABLE STORAGE CONTAINER AND HEAD REST

[76] Inventor: Donald De Fries, 5223 N. Oakview, Chicago, Ill. 60656

[21] Appl. No.: 937,894

[22] Filed: Aug. 29, 1978

[51] Int. Cl.[3] ..... A45C 9/00

[52] U.S. Cl. ..... 190/42; 5/431; 190/51; 190/57; 150/2.5

[58] Field of Search ..... 5/431, 491, 442; 190/42, 41.2, 57, 51, 1; 150/1.5 B, 52 G, 35, 52 R, 2.5, 0.5; 220/23

[56] References Cited

U.S. PATENT DOCUMENTS

| | | | |
|---|---|---|---|
| 284,792 | 9/1883 | Allaben | 220/23 |
| 2,107,201 | 2/1938 | Krupp | 150/35 |
| 3,128,854 | 4/1964 | Specht | 190/41.2 |
| 3,263,246 | 3/1964 | Towery | 190/42 |
| 4,081,870 | 4/1978 | Iannucci | 5/431 |

FOREIGN PATENT DOCUMENTS

| | | | |
|---|---|---|---|
| 327962 | 3/1958 | Fed. Rep. of Germany | 150/0.5 |

OTHER PUBLICATIONS

Publication of Invention #2777, dated 4/30/87, entitled a "Combination" Valise.

*Primary Examiner*—Herbert F. Ross
*Attorney, Agent, or Firm*—Bernard L. Kleinke

[57] ABSTRACT

A combination portable storage container and head rest includes an elongated outer resilient tubular member axially aligned with and surrounding an inner rigid tubular member. An elongated covering enclosed the outer resilient member. A large compartment disposed within the inner tubular member is provided for storage purposes, and a small compartment removably mounted within the inner tubular member is provided for additional storage purposes.

6 Claims, 4 Drawing Figures

FIG. 2
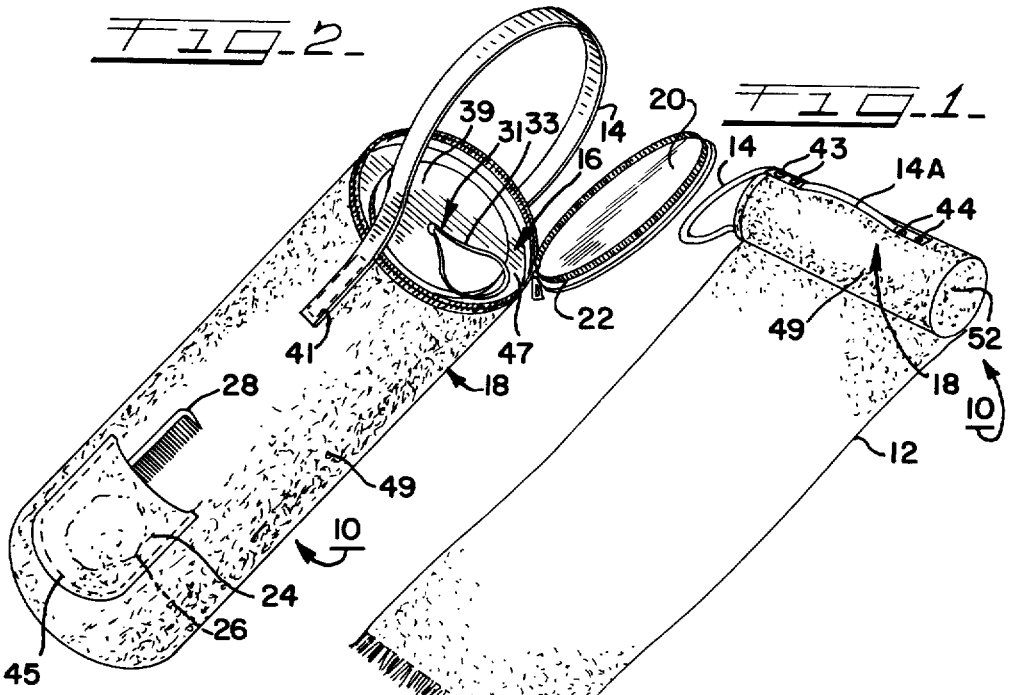
FIG. 1
FIG. 4
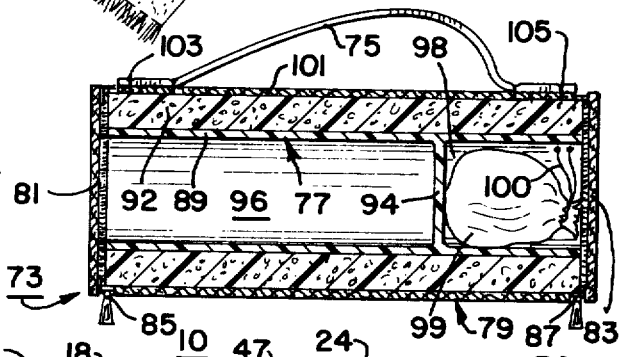
FIG. 3
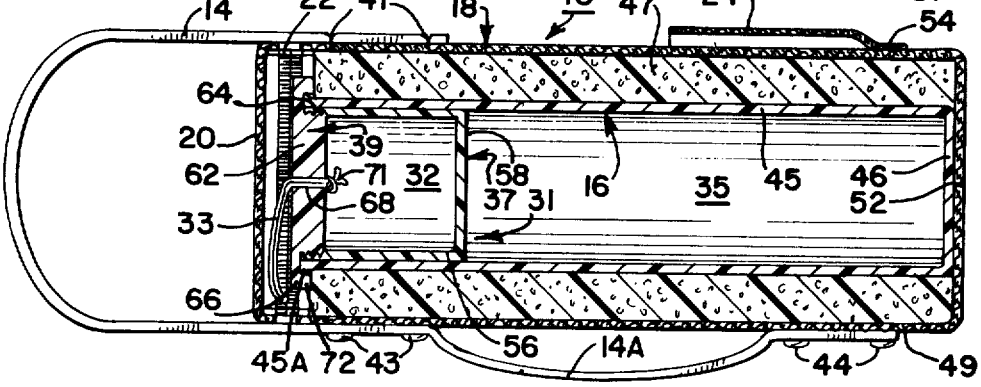

COMBINATION PORTABLE STORAGE CONTAINER AND HEAD REST

BRIEF SUMMARY OF THE INVENTION

The present invention relates in general to a combination portable storage container and head rest, and more particularly relates to a cushion or head rest having storage facilities contained therein.

There have been many different types and kinds of head rests or the like which included storage facilities therein. For example, reference may be made to the following U.S. Pat. Nos.: 1,707,766; 3,263,246; 3,340,969; 3,378,860; 3,879,775; and 4,081,870. In U.S. Pat. No. 3,263,246, there is disclosed a beach pillow having a series of strings for supporting the head and having storage facilities therein. Such a device is adapted to be used at the beach or other recreational areas in connection with swimming and sunning so that personal belongings may be temporarily stored inside the beach pillow. While such a device may be satisfactory for some applications, it would be highly desirable to have a combination portable storage container and head rest, which would be relatively inexpensive to manufacture and would provide removable storage containers so that the user could remove the container and carry his valuables with him. Moreover, such a combination storage container and head rest should be easy to carry and be comfortable to use. Also, such a device should be relatively inexpensive to manufacture and esthetically pleasing in appearance. Also, the device should be buoyant and able to float.

Therefore, the principal object of the present invention is to provide a new and improved combination portable storage container and head rest, which provides removable storage facilities therewithin, and which is esthetically pleasing in appearance.

Another object of the present invention is to provide such a new and improved combination portable storage container and head rest which is buoyant and able to float, and which is relatively inexpensive to manufacture and convenient to use.

Briefly, the above and further objects of the present invention are realized by providing a combination portable storage container and head rest, which includes an elongated outer resilient tubular member axially aligned with and surrounding an inner rigid member. An elongated covering encloses the outer resilient member. A large storage compartment is disposed within the inner tubular member for storage purposes, and a small compartment is removably mounted within the inner tubular member for additional storage purposes.

BRIEF DESCRIPTION OF THE DRAWINGS

Other objects and advantages will become apparent to those skilled in the art by reference to the accompanying description and drawings, wherein:

FIG. 1 is a pictorial view of a combination portable storage container and head rest, which is constructed in accordance with the present invention and which is shown used in connection with a beach blanket;

FIG. 2 is an enlarged view of the device shown in FIG. 1 but showing the opposite side thereof;

FIG. 3 is a longitudinal cross-sectional view of the unit of FIG. 2; and

FIG. 4 is a longitudinal cross-sectional view of another combination portable storage container and head rest, which is also constructed in accordance with the present invention.

DETAILED DESCRIPTION

Referring now to the drawings and more particularly to FIGS. 1, 2 and 3 thereof, there is shown a combination portable storage container and head rest 10, which is constructed in accordance with the present invention and which is shown disposed at the head end of a beach blanket 12 to serve as a head rest. It is to be understood that the device of the present invention may be used not only at the beach or for sunning purposes, but it may also be used in connection with boating, camping, or other recreational activities as well.

The device 10 includes a loop handle 14 composed of fabric material for enabling the device to be carried in a convenient manner as hereinafter described in greater detail. The device 10 is generally cylindrical in shape and includes a hollow foam elongated insert 16 extending substantially the entire length of the device 10 to cushion it so that the device can serve as a head rest. An elongated generally cylindrical fabric cover or covering 18 encloses the entire device 10 and includes an end flap 20 for access to the insert 16. The end flap 20 of the cover 18 is held in place removably by means of a slide fastening device 22.

An outer pocket 24 is adapted to store miscellaneous personal items, such as the comb 28. An area 26 is disposed on the outer surface of the pocket 24 for advertising purposes or for a personal monogram.

In accordance with the present invention, a removable storage container package 31 is disposed at the interior of the hollow insert 16 for convenient storage of miscellaneous items, including valuable items such as wallets, jewelry or wrist watches within a small compartment 32 therein. A loop handle 33 for the container package 31 enables it to be pulled out from the interior of the device 10 once the flap 20 is moved to its open position as indicated in FIG. 2 of the drawings. A large compartment 35 is disposed within the hollow foam insert 16 and is disposed throughout the length of the device 10, the container package 31 being disposed at the front end of the compartment 35 adjacent the end flap 20 of the cover 18 as best seen in FIG. 3 of the drawings. Thus, the user can remove the package 31 containing valuable personal items from the interior of the device 10 and carry the package with the user and leave the device 10 at a recreational area.

The container package 31 includes an opened-top cup or container 37 which is generally cylindrical in shape and disposed snugly within the front end portion of the large compartment 35. A cover or closure 39 extends over the open top of the container 37 to close it.

Considering now the loop handle 14 in greater detail with reference to the drawings, the handle 14 generally comprises a long narrow strip of flexible fabric material and is sewn at 41 to the cover 18 near its front end. The handle 14 extends therefrom to the diametrically opposite side of the cover 18 and is fixed releasably intermediate its ends by a pair of snap fastening devices 43 to the cover 18 near the front end thereof, thereby forming an end handle portion. The handle 14 extends from the snaps 43 and is bowed outwardly from the cover 18 at 14A to form an additional side handle portion, and is fixed at its opposite end in a releasable manner to the cover 18 near the rear end portion thereof by means of a pair of snap-fastening devices 44. As a result, the opposite end of the strip may be detached from the cover 18 by means of the snap fastening devices 44 and the female portions of the devices 44 snapped into engagement with the male portions (not shown) of the devices 43 to enlarge the end handle portion to serve as a shoulder strap.

Considering now the insert 16 in greater detail with particular reference to FIG. 3 of the drawings, the insert 16 generally comprises a rigid tube 45 which extends substantially the entire length of the device 10 and is preferably composed of rigid plastic material. A rear end wall 46 is integrally connected to the rigid tube 45 to close the rear end thereof. A resilient outer tube 47 surrounds and is fixed to the inner wall 45 to cushion or pad the device 10 to enable it to serve as a head rest. The outer tube 47 may be composed of any suitable resilient material, such as polyurethane foam rubber or the like.

Considering now the cover 18 in greater detail, the cover 18 is generally cylindrical in configuration and has a cylindrical tubular side wall 49 and a fixed rear end wall 52. The end flap 20 serves to close the front open end portion of the cover 18. In this manner, the cover 18 entirely encloses and surrounds the hollow insert 16.

The cover 18 is composed of suitable fabric material, such as nylon or terry cloth material. The pocket 45 is composed of the same material as the material of the cover 18. Similarly, the handle 14 may also be composed of that same material or a more sturdy material.

The pocket 24 is disposed on the outside of the cover 18 near the rear end thereof and is sewn at 45 along three of the four edges thereof.

Considering now the container 37 in greater detail with particular reference to FIG. 3 of the drawings, the container 37 includes a cylindrical wall 56 and an integrally connected bottom wall 58.

The cover 39 includes a plate 62 extending over the open end of the container 37 and is threadably attached thereto at 64 so that the cover 39 can be removed from the container 37 to gain access to the small compartment 32. A downwardly depending skirt or flange 66 fits over the front outer edge of the container 37 at an external annular bead 45A integrally formed on the outer surface of the inner tubular member 45. In this regard, it should be noted that the front end portion of the outer tubular member 47 terminates near the bead 45A so that the flange 66 is able to engage the bead 45A. In this manner, air can be trapped in the interior of the large chamber 35 to render the entire device buoyant so that it floats. In this manner, the device 10 is not easily lost if dropped from a boat or a pier, since it floats in the water. Also, the device 10 can serve to help support a person in the water.

The loop handle 33 is composed of suitable flexible material, such as cord or the like, and has its ends extending through a central opening 68 and fixed in place by means of a knot 71 disposed at the rear face of the plate 62. In order to ensure that the interior of the large chamber 35 remains airtight, the end portions of the loop handle 33 are sealed within the central opening 68.

Referring now to FIG. 4 of the drawings, there is shown another combination portable storage container and head rest 73, which is also constructed in accordance with the present invention. The unit 73 includes a side handle 75 for carrying purposes. The unit 73 further includes a hollow foam insert 77 which is similar to the foam insert 16 of the rest 10. A cover 79 encloses the foam insert 77 and is similar to the cover 18 of the rest 10. The cover 79 is cylindrical in shape and has a pair of hinged flaps 81 and 83, each of which is similar to the end flap 20 of the rest 10. A slide fastening device 85 releasably attaches the periphery of the front end flap 81 to the body portion of the cover 79 in a similar manner as the slide fastening device 22 of the rest 10. Similarly, a slide fastening device 87 releasably attaches the periphery of the rear end flap 83 to the body portion of the cover 79. Thus, the end flaps 81 and 83 permit access to either end of the hollow foam insert 77.

The hollow insert 77 is generally tubular in configuration and includes a rigid inner tube 89 which is similar to the inner tube 45 of the rest 10. An outer tube 92 is composed of resilient material and surrounds the rigid inner tube 89, the outer tube 92 being similar to the outer tube 47 of the rest 10.

A transverse wall 94 is integrally connected to the inner rigid tube 89 to serve as a divider wall between a large compartment 96 and a small compartment 98 at the inside of the hollow interior of the inner tube 89. Thus, access may be gained to the large compartment 96 through the front open end of the inner tube 77 via the front flap 81. Similarly, access may be gained to the small compartment 98 through the open rear end of the inner tube 77 via the rear flap 83 of the cover 79.

Disposed within the rear small compartment 98 is a bag or sack 99 having a drawstring top 100. In this regard, the sack 99 is composed of flexible fabric material, such as nylon material, and enables the user to place valuable items, such as wallets and jewelry, therein. As a result, the sack 99 may be removed from the compartment 98 and carried by the user in a similar manner as the container 37 may be removed from the rest 10.

Considering now the cover 79 in greater detail, the cover 79 is composed of similar material as the cover 18 of the rest 10. The cover 79 includes a cylindrical side wall 101 to which are secured at their opposite ends the end flaps 81 and 83.

The handle 75 is sewn at its opposite ends to the cylindrical side wall 101 at 103 and 105 so that the handle 75 extends axially along the cover 79 to serve as a side handle.

It will become apparent to those skilled in the art that both the large compartment 35 and 96 of the respective rests 10 and 73 can be used not only for large items, such as storing a beach blanket or clothes, but also the large compartment can be at least partially filled with ice cubes so that containers of beverages can be stored therein and remain cold. Such is possible since at least the side and rear walls of the large compartments are liquid-tight.

Due to the sturdy construction of the units of the present invention, they can be stood upright on their ends to serve as a convenient seat for the user.

While there have been described above the principles of the present invention in connection with specific devices, it is to be clearly understood that this description is made only by way of example and not as a limitation to the scope of the invention. There may be many different modifications to the disclosed embodiments of the present invention. For example, different types of materials may be employed, such as metal material may be used in place of the plastic material forming the inner tube of the hollow foam inserts. Therefore, the invention should only be limited by the true spirit and scope of the appended claims.

The embodiments of the invention in which an exclusive property or privilege is claimed are defined as follows:

1. A combination portable storage container and head rest, comprising:

an elongated inner rigid tubular member having front and rear ends;

an elongated outer resilient tubular member having front and rear ends and being axially aligned with and surrounding said inner rigid member;

an elongated covering enclosing said outer resilient member, said covering having openable means for permitting access to the interior thereof;

means defining a large storage compartment disposed within said inner tubular member for storage purposes;

small container means removably mounted within said inner tubular member for additional storage purposes, whereby access to said compartments is available through said openable means, the inner and outer tubular members each being open at least at their front ends, said inner member includes a rear end wall, said covering being composed of flexible fabric material and having an end flap serving as a closure member for the open ends of said inner and outer tubes;

fastening means for holding releasably said end flap in its closed position over said open ends, said covering having a generally cylindrical body portion and its end flap being generally circular in shape, said fastening means including a slide fastening device interconnecting said body portion and said flap; and handle means fixed to the outer surface of said covering to facilitate carrying the unit, said handle means being composed of a single strip of flexible material, said strip being fixed at one of its ends to said covering near the front end portion thereof; said strip being detachably connected intermediate its ends to the opposite side of the covering near said front end to form an end handle portion, said strip being detachably connected at its opposite end near the rear end portion of said covering to form a side handle portion, whereby said opposite end of said strip may also be attached near said front end portion to enlarge said end handle portion to serve as a shoulder strap.

2. A combination portable storage container and head rest according to claim 1, wherein said inner and said outer tubes are each open at both of their ends, said covering being composed of flexible fabric material and having a pair of end flaps serving as closure members for the open ends of said inner and said outer tubes, further including means for holding releasably said end flaps in their closed positions over the opposite open ends of said inner and said outer tubes.

3. A combination portable storage container and head rest according to claim 1, wherein said inner member includes an open front end and a closure member for sealing releasably said open front end in an airtight manner to render said combination buoyant in water.

4. A combination portable storage container and head rest according to claim 1, wherein said small container means is removably mounted within said inner member near said openable means of said covering.

5. A combination portable storage container and head rest according to claim 4, wherein said small container means includes an openable sack composed of fabric material adapted to be removed from the interior of said inner member.

6. A combination portable storage container and head rest according to claim 4, wherein said small container means includes a container having an open top and a cover detachably secured to said container over said open top, said container being disposed removably within said large compartment.

* * * * *